United States Patent [19]

Kinney, Jr. et al.

[11] Patent Number: 4,663,092

[45] Date of Patent: May 5, 1987

[54] EXTRUDED FILL BAR FOR WATER COOLING TOWERS

[75] Inventors: Ohler L. Kinney, Jr., Leawood; James R. Houx, Jr., Shawnee Mission, both of Kans.; Gerald D. Fritz, Raytown, Mo.

[73] Assignee: The Marley Cooling Tower Company, Mission, Kans.

[21] Appl. No.: 819,220

[22] Filed: Jan. 14, 1986

[51] Int. Cl.[4] ..... B01F 3/04

[52] U.S. Cl. ..... 261/111

[58] Field of Search ..... 261/111

[56] References Cited

U.S. PATENT DOCUMENTS

| | | | |
|---|---|---|---|
| 736,087 | 8/1903 | Graham . | |
| 1,234,444 | 7/1917 | Burhorn . | |
| 2,207,272 | 2/1940 | Simons | 261/111 |
| 2,239,936 | 4/1941 | Simons | 261/111 |
| 2,336,060 | 12/1943 | Bragg . | |
| 3,189,329 | 6/1965 | Smith et al. . | |
| 3,378,239 | 4/1968 | Engalitcheff, Jr. et al. . | |
| 3,389,895 | 6/1968 | De Flon . | |
| 3,647,191 | 3/1972 | Fordyce . | |
| 3,894,127 | 7/1975 | Fordyce . | |
| 3,969,447 | 7/1976 | Glitsch et al. | 261/111 |
| 4,048,265 | 9/1977 | Fordyce et al. . | |
| 4,115,484 | 9/1978 | Saxton . | |
| 4,133,851 | 1/1979 | Ovard | 261/111 |
| 4,181,691 | 1/1980 | Cates et al. | 261/111 |
| 4,439,378 | 3/1984 | Ovard | 261/111 |
| 4,512,937 | 4/1985 | Hoffman | 261/111 |
| 4,515,735 | 5/1985 | Phelps | 261/111 |
| 4,557,878 | 12/1985 | Fulkerson | 261/111 |
| 4,578,227 | 3/1986 | Ovard | 261/111 |

FOREIGN PATENT DOCUMENTS

| | | |
|---|---|---|
| 1965230 | 9/1970 | Fed. Rep. of Germany . |
| 1945048 | 11/1971 | Fed. Rep. of Germany . |

OTHER PUBLICATIONS

Cooling Tower fundamentals, The Marley Cooling tower Company; Mission, Kansas John C. Hensley.

*Primary Examiner*—Tim Miles

*Attorney, Agent, or Firm*—Schmidt, Johnson, Hovey & Williams

[57] ABSTRACT

A splash bar for use in fill structure of an evaporative cooling tower has an extruded body with an elongated water impingement portion operable to uniformly disperse deflected water throughout the fill structure for contact with passing air. The splash bar body comprises a pair of arcuate in cross section side margins and an elongated, horizontal, flat top segment interconnecting the side margins. The centers of curvature of the side margins are coincident and lie beneath the body, while the width of the flat top segment is in the range of approximately 15% to approximately 35% of the overall width of the body. In preferred forms of the invention, the width of the flat top segment is approximately 25% of the overall width of the body. Advantageously, the body is hollow and includes a pair of spaced, flat, coplanar bottom walls integrally extending inwardly from the side margins. In alternate forms of the invention, the splash bar includes a pair of outwardly extending elongated side flanges coupled to the body and having notches adapted for clearing upright grid members, in order to substantially preclude longitudinal shifting of the bar as a result of vibration from the tower during operation.

12 Claims, 13 Drawing Figures

Fig. 1
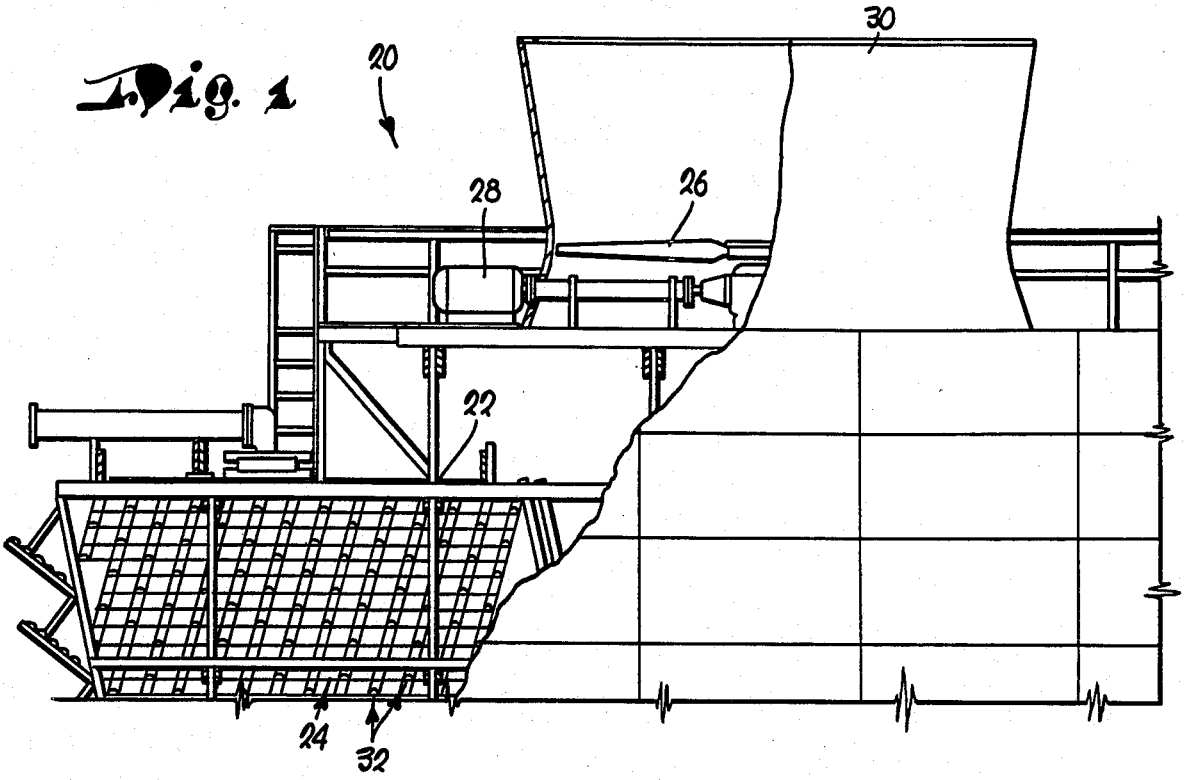
Fig. 5
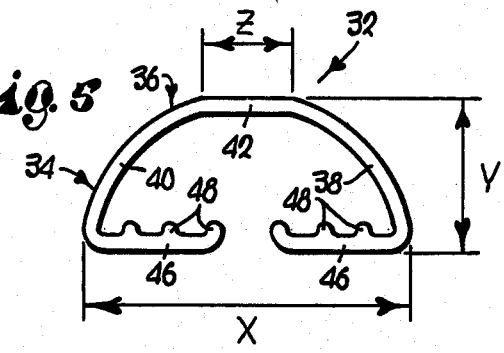
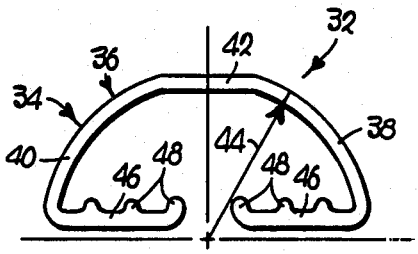
Fig. 6
Fig. 7
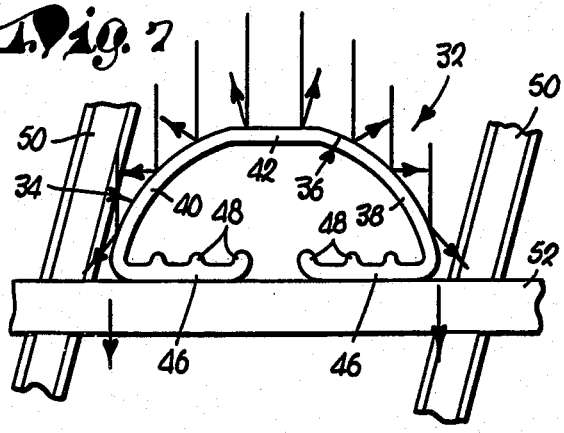
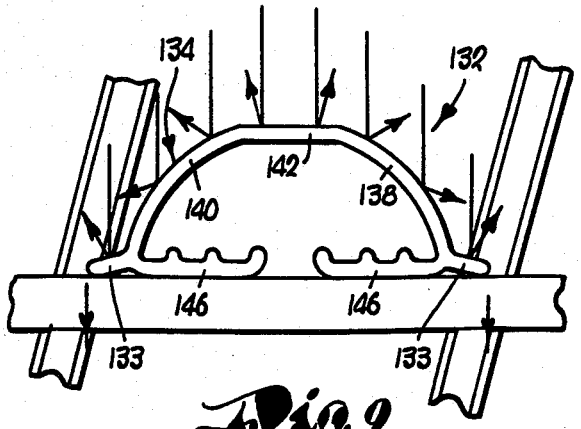
Fig. 9

Fig. 2
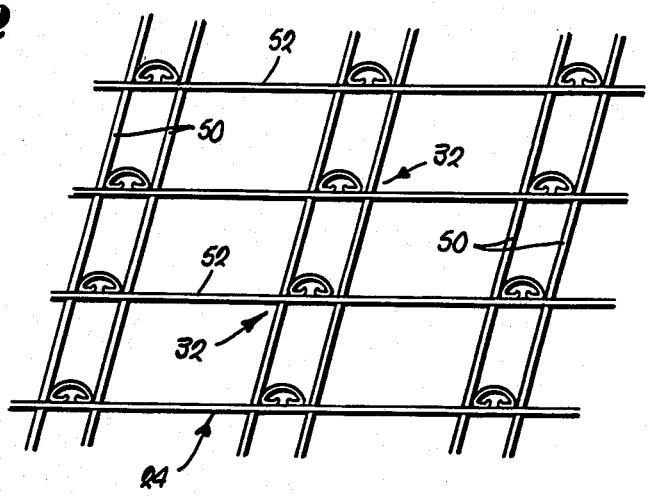
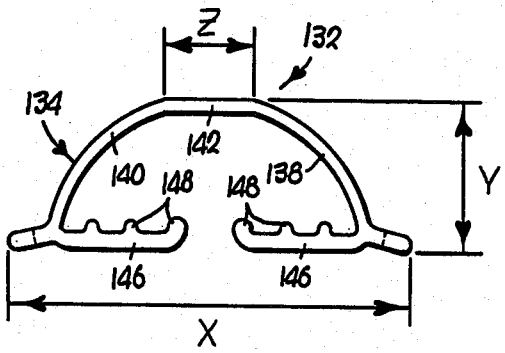
Fig. 8
Fig. 3
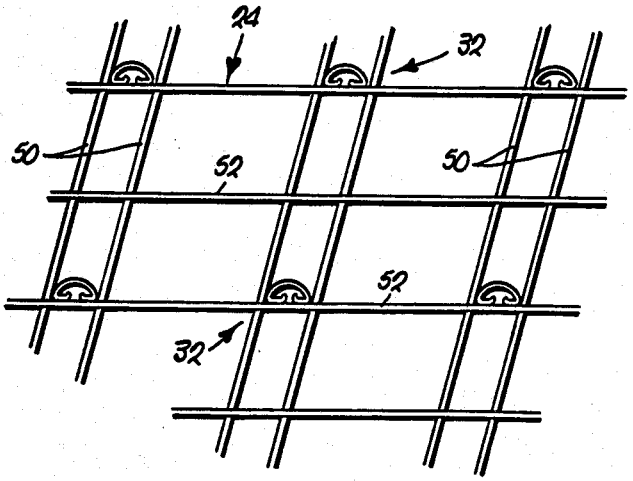
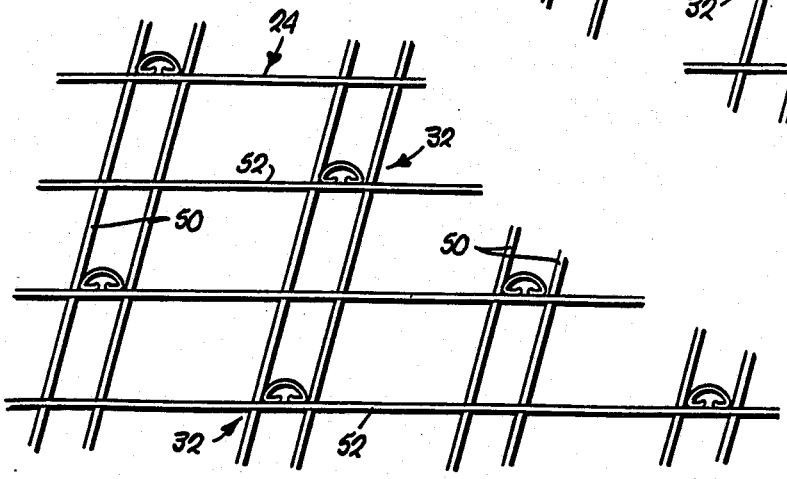
Fig. 4

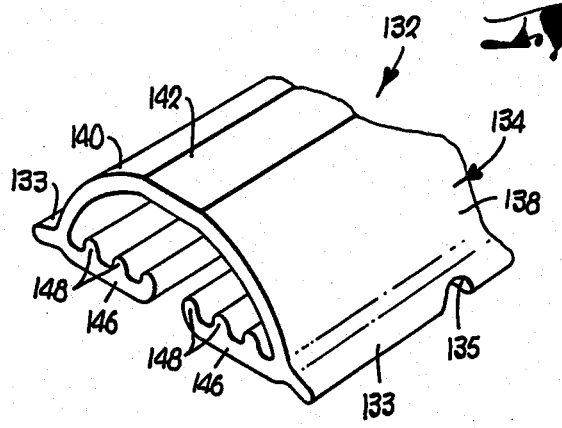

Fig. 10

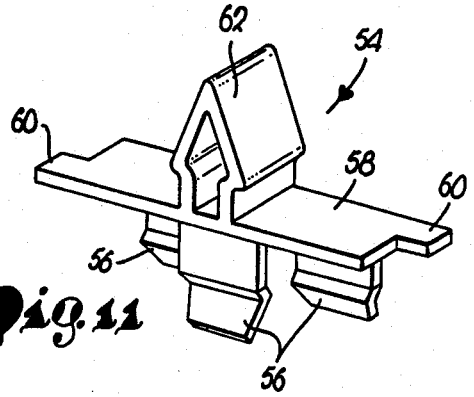

Fig. 11

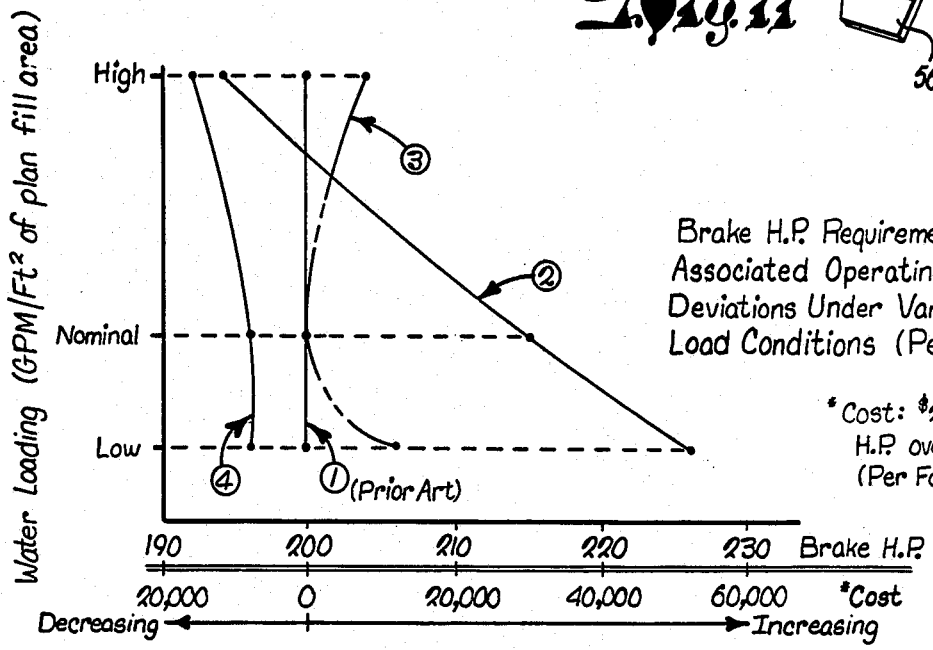

Brake H.P. Requirements and the Associated Operating Cost Deviations Under Varying Water Load Conditions (Per Fan Cell)

*Cost: $2000 per Brake H.P. over the plant life. (Per Fan Cell)

Fig. 12

Fig. 13

Brake H.P. Requirements Under Varying Water Load Conditions

| Water Loading | Fill Type ① 3/8×1½ Rect. Wood Lath | ② Half-Round w/ No Flat | ③ Half-Round w/ Wide Flat (.45x) | ④ Half Round w/ Small Flat (.25x) |
|---|---|---|---|---|
| Spacing | 4"×8" (4.5 Feet/Ft³) | 4"×16" (2.25 Feet of Bar / Ft³) | | |
| High (15 GPM/ft²) | 200 | 194 | 204 | 192 |
| Nominal (8-10 GPM/ft²) | 200 | 215 | 200 | 196 |
| Low (5 GPM/ft²) | 200 | 226 | 206 | 196 |

EXTRUDED FILL BAR FOR WATER COOLING TOWERS

BACKGROUND OF THE INVENTION

1. Field of the Invention

This invention relates to an improved splash bar adapted for use in evaporative water cooling tower fill structure. In particular, the present invention is concerned with an extruded bar comprising a pair of arcuate in cross-section side margins and an elongated, horizontal flat top segment interconnecting the side margins, whereby the transverse cross-sectional configuration of the bar is operable to uniformly disperse water droplets falling in the fill structure and thus improve the overall efficiency of the tower.

2. Description of the Prior Art

In general, evaporative water cooling towers include an upper hot water distribution system such as an apertured distributing pan or the like and a lowermost cold water collection basin. Commonly, a splash type, water dispersing fill structure is displosed in a space between the hot water distribution system and the cold water collection basin, and the fill structure includes a plurality of elongated, horizontally arranged splash bars supported at spaced intervals by upright grid structure. Hot water discharged from the distribution pan falls onto the bars and disperses, forming smaller droplets to facilitate the cooling process. At the same time, cooling air currents are drawn through the fill structure, either by means of motor driven fans or through use of a natural draft-inducing hyperbolic tower.

The fill structure is often regarded as the single most important component of a cooling tower because the fill structure promotes interactive thermal exchange between the water and the air. As water droplets are discharged from the distribution pan, the temperature difference between the relatively warm water and the cooling air causes evaporation on the surface of the drops and cooling of the water occurs at a rapid rate. However, as the surface temperatures of individual droplets approaches the wet bulb temperature of the surrounding air, the cooling process is diminished and is dependent upon the rate of heat transfer from the inside of the drop to the outside of the drop surface. As such, it is desirable to interrupt the fall of individual drops by splashing the drops on a fill bar, thus instantly exposing new water surfaces and, in some cases, subdividing the drops into smaller droplets to increase the water surface area available for exposure to the passing air.

As can be appreciated, the characteristics of any fill structure splash bar must meet several criteria to assure satisfactory operational performance. First, the splash bar should provide consistent, predictable dispersal and break-up of the water droplets over a range of water loadings typically encountered in practice. Preferably, the descending droplets are uniformly broken into relatively fine particles in a widely divergent pattern to facilitate enhancement of the cooling process. However, the splash bar structure should cause a minimum amount of air pressure drop in order to keep fan horsepower requirements as well as operating costs at relatively low levels. Additionally, the splash bar should have sufficient structural strength to span the distance between adjacent upright grid structures, since deflection of the bars can enable the water to channel toward the low point of the bar, thereby causing unequal water dispersal throughout the passing airstream. This problem of bar deflection is more common when the bars are formed of synthetic resin material, since such bars often lose strength and stiffness when subjected to the elevated temperatures of the hot water to be cooled.

Moreover, cost is an important consideration in the selection and fabrication of splash bars. For example, a lrge hyperbolic induced-draft tower may utilize two million or so bars, each four feet in length. As a result, the use of bars formed of expensive metallic materials cannot usually be economically justified, even though metallic bars may provide adequate performance.

In the past, splash bars have often been comprised of elongated, rectangular in cross-section boards of such wood species as redwood or treated Douglas fir. However, wood splash bars, even when normally rot resistant, can deteriorate due to chemicals in the water stream. Also, wood bars present a serious fire hazard as soon as the water flow is interrupted and the moisture remaining on the bars has substantially evaporated.

To enhance the cooling performance of the fill structure, a variety of splash bar configurations have been proposed as an alternative to traditional, rectangular members. In U.S. Pat. No. 3,389,895 to Deflon, dated June 25, 1968, a number of splash bar configurations are illustrated, including an inverted V-shaped bar, a generally crescent-shaped bar, as well as a sheet material with transverse corrugations. Also, it is known that certain splash bars have comprised tubular, hollow extrusions of polyvinyl chloride, wherein a top water impinging surface is generally transversely semicircular and a bottom portion has been deformed upwardly to present a pair of spaced-apart, lower support surfaces. Although splash bars having curved, upper water impinging surfaces provide somewhat improved performance in comparison to rectangular boards at high water loadings, the performance of such curved bars decreases rapidly at relatively low water loadings. As can be appreciated, there is yet a need for an improved splash bar which optimizes cooling efficiency of the tower, in order that the fan brake horsepower requirements and the associated operating costs are minimized.

SUMMARY OF THE INVENTION

The present invention improves the state of the art by provision of a fill structure splash bar having a particular cross-sectional configuration which enables more uniform dispersal and exposure of the water droplets to the passing air stream. The fan horsepower requirements, as well as the associated operating costs, are minimized regardless of fill structure water loadings.

In more detail, the splash bar of the present invention comprises an elongated, extruded polyvinyl chloride body having an upper water impingement portion with a pair of elongated, arcuate in cross-section side margins and an elongated, flat, horizontal top segment interconnecting the side margins. The flat top segment has a width in the range of approximately 15% to approximately 35% of the overall width of the splash bar body, although preferably the width of the top segment is approximately 25% of the overall width of the body. Moreover, the centers of curvature of the side margins are concident and lie along an axis disposed beneath the body. Optionally, the body includes a pair of substantially flat, co-planar, spaced bottom walls extending inwardly from the curved side margins.

As such, the water impingement surface of the splash bar having both a flat top portion as well as rounded, side portions, is believed to improve the overall efficiency of the cooling tower by enabling a balance to be achieved between the quantity of water drops which hit the flat surface, break up into smaller droplets and splatter upwardly in the space above the bar and the number of drops which impinge the curved side margins and are deflected laterally in various directions after breaking into smaller droplets. Such performance is to be contrasted with the operation of typical prior art rectangular bars wherein the deflected droplets tend to concentrate in the space above the bar. Additionally, the performance of the instant invention constitutes an improvement over the operation of splash bars having a continuous rounded impingement surface, since the latter tends to deflect all of the descending droplets in a lateral direction.

The splash bar as disclosed herein demonstrates enhanced performance at a range of water loadings, such that a single fill bar is universely usable at various installations. As is known, the fill structure water loading, in gallons per minute per square foot of projected fill area, is generally constant for each tower installation and is determined by the design heat load. However, water loadings may vary from installation to installation, and thus the splash bar of the present invention can reduce inventory as well as tooling costs.

In one embodiment of the invention, the splash bar body has a pair of outwardly extending, elongated side flanges that are notched at appropriate intervals to clear upright grid members. The notched flanges thus prevent longitudinal shifting of the bars which might otherwise occur due to the vibration typically encountered in use. Alternatively, a retainer may be inserted into the space between the bottom walls and secured to a horizontal grid member, and the remainder can include horizontal support plates which isolate the bar from the grid structure and thereby prevent wear dur to friction.

Moreover, the performance of the instant splash bar, when employed at staggered spacings of 16 inches horizontally and 4 inches vertically, exceeds the performance of typical wood boards or laths maintained at spacings of 8 inches horizontally and 4 inches vertically. As a result, only half of the number of bars of the present invention is required, enabling a substantial economic benefit to be realized, both in labor as well as material costs. Additionally, as compared to wood boards, the extruded, polyvinyl chloride bars do not readily deteriorate and also do not constitute a serious fire hazard.

BRIEF DESCRIPTION OF THE DRAWINGS

FIG. 1 is a fragmentary view in partial section illustrating a mechanical draft, crossflow evaporative water cooling tower, having a water dispersing fill structure utilizing splash bars in accordance with the present invention;

FIG. 2 is an enlarged, fragmentary, side cross-sectional view of the fill structure of FIG. 1, except that the splash bars are spaced at non-staggered, 8 inch horizontal intervals and 4 inch vertical intervals;

FIG. 3 is a view similar to FIG. 2 wherein the splash bars are located in a non-staggered pattern on 8 inch horizontal centers and 8 inch vertical centers;

FIG. 4 is a view similar to FIG. 2, showing the preferred placement of the bars, wherein the latter are disposed in staggered relationship at 16 inch horizontal spacings and 4 inch vertical spacings;

FIG. 5 is an enlarged, cross-sectional view of the splash bar of the present invention according to one embodiment;

FIG. 6 is a view similar to FIG. 5 depicting the center of a radius of curvature for a pair of arcuate side margins of the bar;

FIG. 7 is a fragmentary, enlarged sectional view illustrating the bar of FIG. 5 and upright grid structure utilized to support the bar additionally schematically depicting the deflection of the water droplets during operation of the tower;

FIG. 8 is an enlarged, cross-sectional view of the splash bar of the present invention according to another embodiment;

FIG. 9 is an enlarged, cross-sectional illustration of the bar of FIG. 8 and supporting, upright grid structure additionally illustrating the dispersal pattern of the deflected water droplets;

FIG. 10 is a fragmentary, enlarged, perspective view of the splash bar shown in FIG. 8, illustrating the notches for clearing the upright grid members;

FIG. 11 is an enlarged, perspective view of a clip optionally utilized in connection with the splash bar for securing the latter to the upright grid structure;

FIG. 12 is a comparative graph depicting the required fan horsepower and associated operating costs over the calcined life of a power plant at various water loadings for prior art rectangular wood bars, half rounded splash bars, as well as splash bars constructed in accordance with the principles of the present invention; and FIG. 13 is a comparative chart enumerating the values obtained by test results and utilized in formation of the comparative graph of FIG. 12.

DETAILED DESCRIPTION OF THE DRAWINGS

Referring initially to FIG. 1, a mechanical draft crossflow evaporative water cooling tower is designated broadly by the numeral 20 and includes a water distribution system having an apertured distribution pan 22 for receiving hot water to be cooled and dispensing the same toward an underlying, splash type water dispensing fill structure 24. Water falling through the structure 24 is collected by a cold water collection basin (not shown) at a lowermost portion of the tower 20, and subsequently is directed back to a point of use. As is common with towers of this type, a fan 26 is powered by a motor 28 for drawing ambient air currents through the fill 24 in generally crossflow relationship to the hot water descending from the distribution pan 22, with the heated air passing back to the atmosphere through a venturi-shaped fan stack 30. However, it is to be understood that the principals of the present invention, to be described in detail hereinbelow, are equally useful with hyperbolic, natural, draft-induced cooling towers.

More particular, the fill structure 24 includes a series of splash bars 32, as shown in FIGS. 1–7. The bars 32 comprise an elongated body 34 having an upper, elongated water impingement portion 36. As shown, the impingement portion 36 comprises a pair of elongated, arcuate in cross-section side margins 38, 40 and an elongated, flat, horizontal top segment 42 interconnecting the curved margins 38, 40. The body 34 has an overall height generally less than one-half of its width, and the flat top segment 42 has a width in the range of approximately 15% to approximately 35% of the width of the body 34. In preferred forms of the invention, the width of the segment 42 is approximately 25% of the width of the body 34.

In one embodiment of the invention, as viewed best in FIGS. 5–7, a preferred overall width of the body 34, as represented by the letter "X" in FIG. 5, is 1.655 inches. In this preferred form, the overall height of the body 34, as represented by the letter "Y", is 0.750 inch, while the width of the flat top segment 42, as indicated by the letter "Z", is 0.437 inch. Viewing FIG. 6, each of the side margins 38, 40 have a curved cross-sectional configuration with a center of curvature lying 0.065 inch beneath the body 34. As illustrated, the centers of curvature of the side margins 38, 40 are preferably coincident, and a preferred radius, as represented by the radius line indicated by the numeral 44, is 0.844 inch.

As shown in FIGS. 5–7, the body 34 includes a normally horizontal bottom wall means connected to the side margins 38, 40, and the bottom wall means comprises a pair of substantially flat, co-planar, spaced walls 46, 46 extending inwardly in integral relationship from the margins 38, 40. Also, the walls 46, 46 each include three elongated, upright, integral ribs 48 for providing strength and stiffness to the body 34.

The fill structure 24 also includes an upright grid structure for supporting the bars 32 in proper disposition within the tower 20. The grid structure comprises upright, inclined grid members 50 as well as a series of spaced horizontal grid members 52.

The splash bars 32 may be supported by the upright grid structure in a variety of patterns. Referring to FIG. 2, successful performance is observed when the bars 32 are supported in a non-staggered relationship by the members 50, 52 on 8 inch horizontal centers and 4 inch substantially vertically centers. Good results are also obtained when the splash bars 32 are disposd in the non-staggered pattern represented in FIG. 3, wherein the bars 32 are located on 8 inch horizontal centers and 8 inch substantially vertical centers. However, a preferred disposition of the bars 32 is shown in FIG. 4, wherein the bars 32 are located in a staggered pattern on 16 inch horizontal centers and 8 inch substantially vertical centers.

FIG. 7 is a representation of the believed paths of travel for water droplets impacting against the outer surface of the impingement portion 36. Droplets hitting the curved side margins 38, 40 are deflected approximately at an angle equal to their angle of incidence. That is to say, at a point where the droplets hit either of the curved margins 38, 40, the droplets will be deflected at an angle from a perpendicular line drawn through a tangent line at the impact point, where such an angle is equal to an angle between the perpendicular line and the vertical path of the drop before engaging the impingement portion 36. However, water droplets impacting the flat top segment 42 will rebound, on the average, at a slight angle in a random pattern, because a portion of the droplets falling downwardly functions as deflectors to push the rebounding drops laterally.

The improved performance of the splash bar 32 is believed to be caused by a balance achieved between the quantity of water droplets which hit the flat top segment 42, and the number of droplets which impact against the curved margins 38, 40. The droplets are uniformly dispersed in the vicinity surrounding each splash bar 32 such that a more uniform exposure of the droplets to the crossflowing air stream enhances the cooling process. Additionally, most of the droplets engaging the impingement surface 36 tend to break into smaller drops, thereby increasing the surface area of the water in contact with the passing air stream.

Referring to FIGS. 12 and 13, the improved results obtained by use of the splash bar 32 of the present invention are compared to test results obtained by use of splash bars of different configuration under similar circumstances. Test data from commonly used rectangular wood boards is indicated by the numeral "1" in FIG. 12 (see also the column labeled "1" in FIG. 13), and represents a base line for comparing performance of splash bars having different configurations. The fan motor requirements are taken as 200 brake horsepower per fan regardless of water loading when rectangular boards are spaced on 4 inch vertical centers and 8 inch horizontal centers. Data obtained from test results of a half rounded splash bar, having no upper flat impingement surface, is represented by the numeral "2", and it can be seen that although performance of this type of bar is superior to rectangular boards under high loadings such performance falls off rapidly under lower water loadings. Test results from use of a half rounded splash bar, having a relatively wide flat top segment of a width equal to approximately 45% of the overall width of the splash bar, is indicated by the curve labeled "3". As illustrated, the performance of such a splash bar does not exceed the performance of rectangular boards regardless of water loadings. However, unexpected results were discovered when the splash bar 32 of the instant invention was tested, wherein data as represented by the numeral "4" shows superior performance than that obtained by use of rectangular boards, half-rounded bars, or half-rounded splash bars having a relatively wide flat top segment. As indicated, the performance of the bar 32, when the width of the top segment 42 is approximately equal to 25% of the overall width of the body 34, is superior to the results obtained from use of other tested splash bars regardless of water loadings.

Moreover, the test results as enumerated in FIG. 13 represent conditions wherein the bar 32 is located on 16 inch horizontal centers in rows on 4 inch vertical centers in contrast to the 8 inch horizontal spacing and 4 inch vertical spacing provided during testing of the rectangular wood boards. Thus, superior results are obtained even though half the number of bars are needed, resulting in a substantial savings of both material and labor. Moreover, such a reduction in the number of bars 32 within the fill structure 24 ensures that the pressure drop of the passing air stream is retained at a minimum. As shown in FIG. 12, the reduction in operating costs for each fan cell, calculated at $2,000 per brake horsepower over a 20 year plant life, in early 1985 U.S. Dollars, ranges from approximately $7,500 to over $16,000. Obviously, such a savings is significantly compounded when based upon a multicell cooling tower having, for instance, ten fan cells.

FIG. 11 illustrates a retainer 54 which may be advantageously utilized to secure the bars 32 to the grid members 50, 52. As shown, the retainer 54 has three spaced, depending, flexible tabs 56 which can be deflected laterally to engage the horizontal grid member 52. The retainer 54 also is provided with a flat support 58, the underside of which rests on the top of the horizontal grid member 52, and the top surface of which engages the bottom walls 46, 46 of the bar 32. As such, the support 58 isolates the bar 32 from the horizontal member 52 to reduce frictional wear which might otherwise occur due to vibration encountered from operation of the tower 20. Also, the support 58 has opposed, outwardly extending fingers 60, 60 adapted to engage opposite sides of adjacent upright grid members 50, to thereby prevent shifting of the retainer 54 in a direction parallel to the longitudinal axis of the bar 32

The retainer 54 is also provided with an upstanding arrow shaped bar securing means or clip 62. The clip 62 may be snapped into place in the space between the bottom walls 46, 46 in disposition to engage the inwardmost ribs 48. In this regard, a channel between the bottom walls 46, 46 functions not only to enable attachment of the retainer 54 at any location along the length of the bar 32, but also provides material savings and allows the extruder to be operated at a somewhat faster speed.

A second embodiment of the instant invention is represented by the bar 132 in FIGS. 8–10. In this case, the bar 132 has a body 134 similar to the body 34 shown in FIGS. 5–7, but the bar 132 also includes a pair of outwardly extending elongated side flanges 133, 133 integrally coupled to the body 134. The flanges 133 are provided with notches 135 (FIG. 10) of a dimension approximately 0.25 inch wide and 0.125 inch deep, such that the notches 135 accomodate and grip the upright grid members 150 (see FIG. 9). The notches 135 are operable to prevent longitudinal shifting of the bar 132 during tower operation.

In other respects, the configuration of the bar 132 is substantially similar to the bar 32. That is, the body 134 has elongated, curved side margins 138, 140 along with a flat, elongated top segment 142 interconnecting the margins 138, 140. The body 134 also includes inwardly extending flat, spaced bottom walls 146, 146 having ribs 148. Referring to FIG. 8, the preferred overall width of the bar 132, which includes the width of the body 134 (1.655″) plus the width of both side flanges 133, 133 (0.415″) is represented by the letter "X" and is equal to 2.070 inches. The overall height of the body 134 is indicated by the letter "Y", and preferably is 0.750 inch, whle the width of the flat top segment 134, as represented by the letter "Z", is preferably 0.437 inch. Moreover, the centers of curvature of the side margins 138, 140 are coincident and lie 0.065 inch beneath the body 134, and the radius of each curve is 0.844 inch.

FIG. 9 is a believed representation of hypothetical deflection of water droplets impinging upon the bar 132. As noted, the deflection is similar to the water dispersal pattern obtained by use of the splash bar 32 in FIG. 7, with additional water deflecting occuring on the upper surfaces of the side flanges 133, 133 as shown. As a result, the uniform water deflection pattern obtained from use of the bar 132 is believed to provide superior performance, in similar manner to the results obtained from use of the bar 32.

We claim:

1. An evaporative cooling tower splash bar comprising:

an elongated body having an upper, elongated water impingement portion, said impingement portion comprising a pair of elongated, arcuate in cross-section, side margins and an elongated, normally horizontal top segment interconnecting said said margins, said body having a height generally less than one-half of its width, said top segment being flat and having a width in the range of approximately 15% to approximately 35% of the width of said body.

2. The invention as set forth in claim 1, wherein said width of said top segment is approximately 25% of the width of said body.

3. The invention as set forth in claim 1, wherein said side margins each have a curved cross-sectional configuration with a center of curvature lying beneath said body.

4. The invention as set forth in claim 3, wherein the centers of curvature of said side margins are coincident.

5. The invention as set forth in claim 3, wherein said body is hollow.

6. The invention as set forth in claim 5, wherein said body includes normally horizontal bottom wall means connected to said side margins.

7. The invention as set forth in claim 6, wherein said bottom wall means includes a pair of substantially flat, co-planar, spaced walls extending inwardly from said side margins.

8. The invention as set forth in claim 1, wherein said bar includes a pair of outwardly extending, elongated side flanges coupled to said body and having notches adapted for accommodating and gripping upright grid members.

9. Splash type fill structure for an evaporative cooling tower comprising:

an elongated, generally horizontal support member;

a generally horizontal splash bar having a longitudinal axis disposed transversely to the longitudinal axis of said member, said bar having walls defining an elongated channel parallel to said bar longitudinal axis;

retaining means for preventing movement of said bar relative to said member, said retaining means having means selectively fixable to said member, said retaining means also having means selectively fixable with said channel defining walls at any one of a number of locations along said bar; and a pair of upright support members disposed on opposite sides of said bar, and wherein said retaining means includes opposed, outwardly extending portions engageable with said upright members.

10. The invention as set forth in claim 9, wherein said retaining means includes a generally horizontal support intermediate said bar and said horizontal member for reducing friction between said bar and said member.

11. A retainer for cooling tower splash bars comprising:

a normally horizontal support;

means extending upwardly from said support and adapted for engagement with channel defining walls of a splash bar;

means depending from said support and adapted for selective securement to a horizontal grid member; and a pair of finger portions extending outwardly from said support in opposite directions, said portions being adapted for engagement with upright grid members disposed to each side of said splash bar.

12. The invention as set forth in claim 11, said finger portions being generally disposed in a common horizontal plane in offset orientation to engage opposite sides of respective upright members.

* * * * *